United States Patent [19]

Gagon

[11] 4,387,016

[45] Jun. 7, 1983

[54] METHOD FOR EXTRACTION OF BITUMINOUS MATERIAL

[76] Inventor: Hugh W. Gagon, 3350 Florlita Ave., West Valley City, Utah 84119

[21] Appl. No.: 207,145

[22] Filed: Nov. 10, 1980

[51] Int. Cl.[3] ..... C10G 1/04

[52] U.S. Cl. ..... 208/11 LE; 166/267; 166/303; 166/304; 166/306

[58] Field of Search ..... 166/266, 267, 272, 273, 166/274, 303, 304, 305 R, 306; 208/11 LE

[56] References Cited

U.S. PATENT DOCUMENTS

| | | | |
|---|---|---|---|
| 2,173,842 | 9/1939 | Horner | 208/11 LE X |
| 2,453,633 | 11/1948 | Logan | 208/11 LE |
| 2,596,793 | 5/1952 | Schabelitz | 208/11 LE |
| 2,699,832 | 1/1955 | Allen | 166/304 |
| 2,708,481 | 5/1955 | Allen | 166/304 |
| 2,765,850 | 10/1956 | Allen | 166/267 |
| 3,511,774 | 5/1970 | Long et al. | 208/251 R |
| 3,679,264 | 7/1972 | Van Huisen | 166/272 X |
| 3,695,354 | 10/1972 | Dilgren et al. | 166/266 X |
| 3,929,193 | 12/1975 | Duke | 166/303 |
| 3,970,541 | 7/1976 | Williams et al. | 208/11 LE |
| 3,983,939 | 10/1976 | Brown | 166/272 X |
| 4,022,277 | 5/1977 | Routson | 166/267 |
| 4,098,648 | 7/1978 | Kraemer et al. | 208/11 LE X |
| 4,189,376 | 2/1980 | Mitchell | 208/11 LE |

*Primary Examiner*—Stephen J. Novosad
*Assistant Examiner*—George A. Suchfield
*Attorney, Agent, or Firm*—Terry M. Crellin; B. Deon Criddle

[57] ABSTRACT

A process for separating and recovering bituminous material from tar sand and other viscous petroleum deposits, either in-situ or after mining the deposits. The process may also apply to heavy oil wells and to secondary and tertiary recovery of oil from wells. The bituminous-containing matter is contacted within a confined space with the vapors of a halogenated, organic solvent, whereby the bituminous material separates from the other matter. The bituminous material accumulates at the bottom of the confined space and is recovered therefrom.

5 Claims, 2 Drawing Figures

METHOD FOR EXTRACTION OF BITUMINOUS MATERIAL

BACKGROUND OF THE INVENTION

1. Field:

This invention applies generally to the recovery of viscous bituminous material from natural formations containing same. In particular, the invention relates to a process for separating bitumen from tar sands. In addition the invention relates to recovering viscous oil deposits from oil wells and to secondary or tertiary recovery of petroleum from oil wells following primary oil recovery. In other words, the invention is generally valuable for use on all petroleum formations where problems of high viscosity and/or surface adhesion exist.

2. State of the Art:

Large deposits of oil sands or tar sands are found in various parts of the world, in particular in Canada, the United States of America, Venezuela, Russia, and Malagasy. Various attempts have been made in the past to recover the bituminous organic material from tar sands and oil sands. Retorting and other thermal processes are uneconomical due to the large quantity of heat consumed without any effective and efficient recovery thereof.

Processes utilizing water and a hydrocarbon diluent, such as kerosene, have been disclosed. For example, see U.S. Pat. Nos. 2,453,060; 2,825,677; and 3,509,037. Unfortunately, such processes utilize large amounts of heat and water. In addition, these processes are expensive and can cause serious environmental problems due to polluted water and sand which are produced in copious amounts.

Solvent extraction of bituminous organic material from tar sands or oil sands has also been proposed. For example, see U.S. Pat. Nos. 1,514,113; 2,453,633; 2,596,793; 3,050,289; 3,079,326; 3,131,141; 3,392,105; 3,475,318; 3,503,868; 3,509,037; 4,029,568; 4,046,668; 4,046,669; 4,057,485; and 4,110,194. Unfortunately, low yields, high energy consumption, loss of solvents, and environmental problems including dirty spent sands containing both solvent and bituminous material has hindered the development of the solvent extraction processes.

Problems are also encountered with recovery of viscous oil deposits from oil wells and with secondary and tertiary recovery of oil following primary oil recovery. Water and steam injections into the oil field have been used with moderate success. However, it is desirable to develop a more effective method of recovering petroleum from formations where problems of high viscosity and/or surface adhesion exist.

3. Objectives:

A principal objective of the present invention is to provide an efficient process of recovering high yields of bituminous organic material from tar sands, oil sands and other petroleum formations. A particular objective is to provide an efficient solvent vapor extraction process which is economical and which is environmentally clean, i.e., can be operated without polluting the ambient air and water. Another objective of the invention is to develop a process which requires a minimum of energy consumption and achieves a particularly efficient recovery of organic solvent with an effective reuse of heat values. A further objective is to provide a process which uses only small amounts of water, if any. A still further objective is to provide a process which can be used to recover bituminous materials from deposits which have been mined as well as in-situ from deposits within the earth which are economically unsuitable for application of conventional mining techniques.

SUMMARY OF THE INVENTION

It has been discovered that bituminous material can be effectively separated from tar sands and other petroleum formations where problems of high viscosity and/or surface adhesion exist by contacting the bituminous-containing material with the vapors of a halogenated, organic solvent within a confined space. The vapors of the solvent interact with the bituminous material to cause the bituminous material to separate from the inorganic matter and accumulate at the bottom of the confined space.

The accumulated bituminous material is withdrawn from the bottom of the confined space, and residual organic solvent, if any, contained in the withdrawn bituminous material is flashed therefrom. The flashed solvent is reintroduced into the confined space.

The method of the present invention can be readily applied to either mined deposits of the bituminous-containing material or to in-situ deposits. In either instance, a highly efficient separation and recovery of the bituminous matter is achieved. In addition to being highly efficient, the process is also environmentally clean and can be operated with little if any effect on the ambient air and water. The process requires at most only small amounts of water and, therefore, can be utilized in arid regions without depleting or otherwise using scarce water resources within such regions.

The bituminous organic material which is recovered, especially that recovered from tar sand deposits, can be used in many applications without further treatment or refinement. The bituminous material from tar sands has been found to be equivalent to or better than gilsonite in those uses for which gilsonite is in present demand, such as in printer's ink, pipeline insulation, varnishes and paints, concrete foundation sealer, and black-top paving sealers. The bituminous material has also been found to provide excellent coatings for parking terraces, foundations, bridges, wood surfaces of any kind, and underseal coatings for automobiles, locomotives, and other equipment where rust inhibitors are very important. In addition, of course, the bituminous material can be refined for use as a fuel and as petrochemical feedstock.

Additional objects and features of the invention will become apparent from the following detailed description taken, together with the accompanying drawings.

THE DRAWINGS

Particular embodiments of the present invention representing the best mode presently contemplated of carrying out the invention is illustrated in the accompanying drawings in which:

FIG. 1 is a diagram of a method in accordance with the present invention for processing mined tar sands or other mined minerals containing bituminous material; and FIG. 2 is a depiction of a process for the in-situ recovery of bituminous material from an oil well or other underground deposit containing bituminous material.

DETAILED DESCRIPTION OF THE INVENTION

Figure 1:
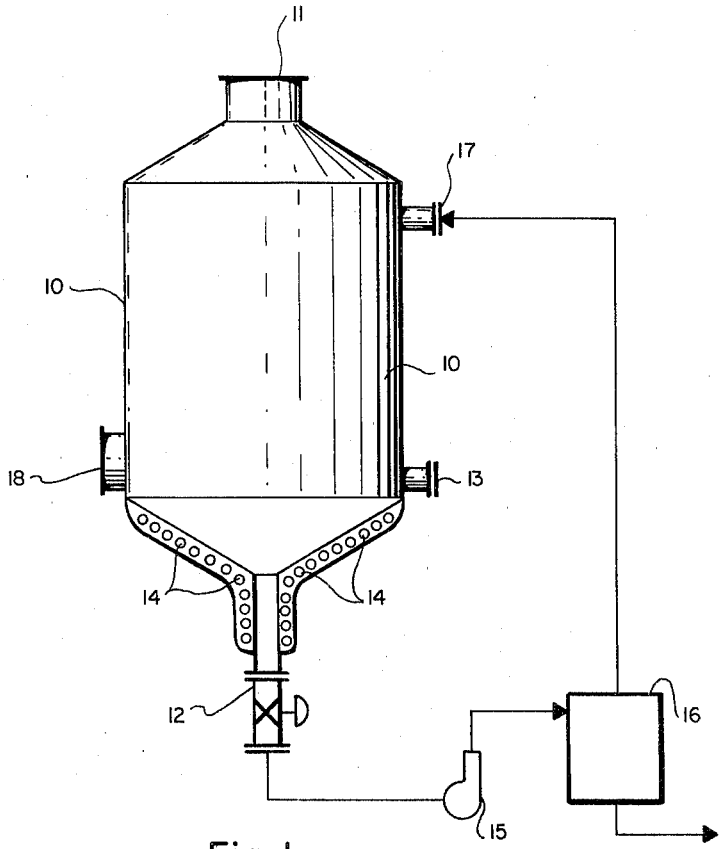

In accordance with the present invention, bituminous material is separated from inorganic matter containing same by a process which is efficient and creates little if any detrimental effect on the environment. The process utilizes solvent extraction techniques requiring a minimum energy investment with efficient recovery and reuse of the solvent which is employed.

A promising new approach to recovery of bituminous material from tar sands and other viscous petroleum deposits, either in-situ or following mining of the deposits, has been discovered. The bituminous-containing matter, while confined within a given space, is contacted with the vapors of a halogenated, organic solvent. The solvent vapors have been found to interact with the bituminous material so that the bituminous material separates from the inorganic matter and accumulates at the bottom of the confined space. The accumulated bituminous material is withdrawn from the bottom of the confined space, and any residual organic solvent contained in the withdrawn bituminous material is flashed therefrom and reintroduced into the confined space.

Halogenated organic solvents which can be used in the present process include methylene chloride, trichloromonofluoromethane, chloroform, methyl chloroform, carbon tetrachloride, bromotrichloromethane, dibromotetrafluoromethane, trichloroethane, trichloroethylene, tetrachloroethane, tetrachloroethylene, hexachloroethane, pentachloromonofluoroethane, pentachloroethane, tetrachlorodifluoroethane, trichlorotrifluoroethane, dichloroterifluoroethane, dibromotetrafluoroethane, and dichlorotetrafluoromethane. These solvents, in the vapor state, are capable of interacting with the bituminous organic material to separate the bituminous material from the inorganic matter with which it was associated and to effect the viscosity of the bituminous material so that it will accumulate at the bottom of the confined space.

By maintaining the temperature of the accumulated bituminous material at the bottom of the confined space above the boiling point of the halogenated solvent which is being used, the residual solvent content of the accumulated bituminous material is kept very low. The small residual solvent content, if any, can be readily flashed from the bituminous material, which is withdrawn from the confined space, with the flashed solvent being reintroduced into the confined space. Solvent losses are exceptionally small as compared to other processes which have been proposed for solvent extraction of bituminous material. Water requirements are minimal inasmuch as water is not used in the separation of the bituminous material. In those situations wherein the tar sands or other bituminous deposit occurs in locations where water resources are scarce, the process of the present can be used with little, if any, effect on the allotment of the water resources. Further, the present process is environmentally clean, i.e., there is no significant pollution of the ambient air and water. In those applications wherein tar sand is mined and then subjected to the present process, a clean sand results which can be further processed to recover mineral values therefrom or disposed of without creating a pollution problem.

An embodiment of the process as utilized in recovering bituminous material from mined tar sands or other mineral matter containing bituminous material is shown schematically in FIG. 1. The crushed tar sands or other mineral matter is introduced into an extraction vessel 10 through a closable opening or port 11. The vessel 10 has a valved port 12 at the bottom of the vessel. Means are provided, such as a side port 13 in the vessel for charging a halogenated organic solvent thereto. Following the addition of the desired amount of solvent to the vessel, the port 13 is closed. At least the lower portion of the vessel 10 is heated such as by electrical heating coils 14 or other appropridate heating means. The lower portion of the vessel 10 is heated so that any liquid which accumulates there is heated to a temperature above the boiling point of the solvent within the vessel 10. It has been found that temperatures of only five degrees Fahranheit to 20 degrees Fahrenheit above the boiling point of the solvent used is sufficient. Higher temperatures can be used if the vessel 10 is constructed so as to withstand the internal pressures developed within the vessel 10 at the higher temperatures.

Vapors of the solvent circulate through the vessel 10 and contact the tar sands or other mineral matter therein. The solvent vapors interact with the bituminous material causing the bituminous material to separate from the sand or other inorganic matter and to accumulate at the bottom of the vessel 10. The actual mechanism of the interaction between the solvent vapors and the bituminous material is not known. The solvent vapors do interact with the bituminous material to reduce the viscosity of the bituminous material and effect a clean efficient separation of the bituminous material from the sands or other inorganic, mineral matter. The liquid, bituminous material which separates from the sand or other solids percolates through the mass of solids in the vessel 10 and accumulates at the bottom of the vessel 10. As mentioned previously, the residual solvent contained in the accumulated bituminous material is very low, inasmuch as the bituminous material which accumulates at the bottom of the vessel 10 is maintained at a temperature higher than the boiling point of the solvent at the pressure within the vessel 10. The top, sides and bottom of the vessel 10 are preferably insulated so as to conserve heat within the vessel 10.

The accumulated bituminous material is withdrawn from the bottom of vessel 10 through the valved port 12. A screen or other means is provided in the port 12 for preventing sand or other solid particles from flowing from the vessel 10 with the liquid bituminous material. The bituminous material withdrawn from the vessel 10 can be pumped by pump 15 to a flash evaporater 16 wherein any residual organic solvent is flashed therefrom. The flashed solvent vapors are reintroduced into the vessel 10 through a port 17 near the top thereof. The bituminous material is recovered from the evaporator 16. Means can be provided, such as a large port 18 near the bottom of the vessel 10, for removing the cleaned sand or other inorganic material from the vessel 10 at least periodically. The cleaned sand or other inorganic material is replaced with raw inorganic matter containing bituminous material through the top port 11.

Figure 2:
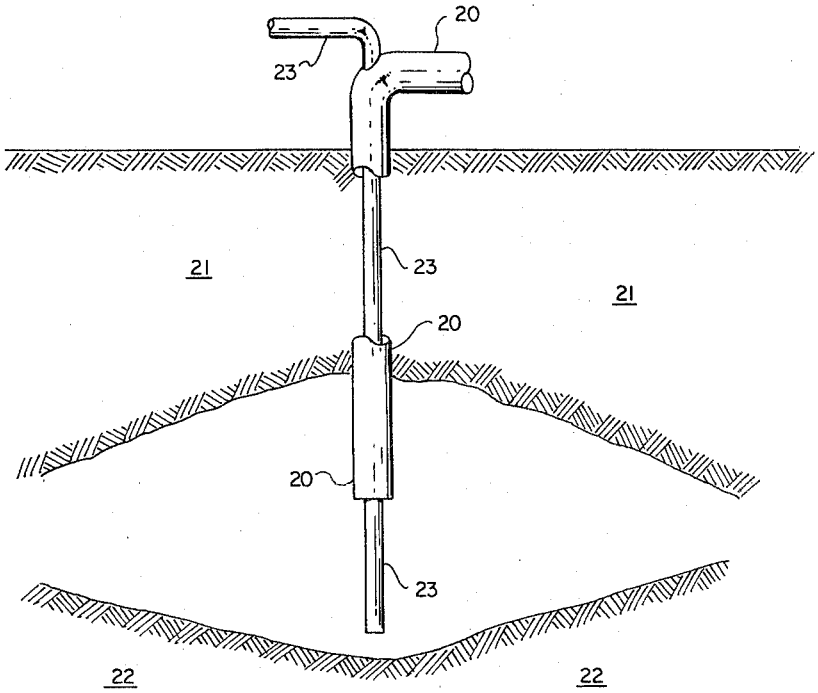

A second embodiment of the process of this invention as utilized in recovering bituminous material in-situ from a tar sand or other petroleum deposit is shown in FIG. 2. The in-situ process can be applied to any underground tar sand or petroleum deposit. However, it is most likely to apply best to deposits having considerable overburden (100 meters or more). The overburden characterizing many tar sand deposits make it economically unfeasible to recover bitumen without an in-situ process. In addition, the in-situ method can be used to recover viscous oil deposits from deep oil wells as well as secondary or tertiary recovery of oil from a well following primary oil recovery.

The in-situ process is carried out as follows: A halogenated solvent such as those mentioned hereinbefore is injected into the underground deposit through a casing 20 extending into the deposit. The solvent is vaporized so that the vapors contact the mineral material in the underground deposit. In those instances wherein the deposit is tar sands, there will generally be insufficient heat in the deposit itself, to vaporize the solvent, i.e., the temperature of the tar sands will generally be less than the boiling point of the solvent which is being used. In such cases, the solvent must be heated and injected into the deposit as a vapor. This is readily accomplished by vaporizing the solvent and introducing the vaporized solvent into the deposit through the casing 20. When the in-situ process is being used to recover viscous oil from an oil well or for secondary or tertiary recovery of oil from a well, the well is usually deep enough that the temperature of the deposit at the bottom of the well is higher than the boiling point of the solvent at the pressure of the well. In such instances, liquid solvent can be introduced into the well and vaporized in-situ by the heat of the deposit at the bottom of the well.

The deposit, either tar sands or other petroleum formation, is positioned in a confined space in-situ between an overburden layer 21 and a base strata 22. At least one well casing 20 communicates with the deposit located between the overburden layer 21 and base strata 22. At least one well casing 23 extends to near the base strata 22 and is used for withdrawing bituminous material from the bottom of the deposit. The two well casings are advantageously arranged coaxial as shown in a single well. However, separate wells and casings can be utilized if desired. The vapors of the organic solvent infiltrate the deposit and interact with the bituminous material or viscous oil whereby the bituminous material separates from the inorganic matter contained in the space confined between the overburden 21 and the base strata 22. The interaction between the bituminous material and the organic solvent also renders the bituminous material much less viscous, and the separated bituminous material percolates through the inorganic matter to the bottom of the space confined between the overburden 21 and the base strata 22. Ideally, the casings 20 and 23 are positioned in a well such that the bottom end of the well casing 23 which extends to near the base strata 22 is positioned within a depression or pocket formed in the base strata 22. Bituminous material which accumulates at the bottom of the confined space is either continuously or periodically withdrawn through the casing 23. Any residual organic solvent in the withdrawn bituminous material is flashed therefrom and the solvent vapors reintroduced into the deposit through casing 20.

After the deposit in the confined space between the overburden 21 and base strata 22 has been effectively treated to separate and recover the bituminous content thereof, the organic solvent can be recovered by displacing the solvent vapors with an inert gas which is lighter than the organic solvent vapors. For example, nitrogen gas can be introduced into the deposit through casing 20. The nitrogen gas rises to the top of the deposit and displaces the organic vapors downwardly and ultimately out of the deposit through the casing 23.

EXAMPLE

Tar sands were placed in a vessel similar to vessel 10 shown in FIG. 1 of the accompanying drawings. The amount of tar sands placed in the vessel on a volumetric basis was about 30 gallons. About 2 gallons of methylene chloride solvent was introduced into the vessel, and the vessel was then closed so as to be essentially air tight.

The bottom of the vessel had a valved port extending therefrom, and the port was heated together with a portion of the conical bottom of the vessel. Sufficient heat was applied to keep the liquid in the bottom of the vessel at about 110 degrees Fahrenheit and to maintain a pressure within the vessel of about 10 psig. Ideally, the amount of solvent to be used is that which, when vaporized, will occupy the void volume existing within the vessel at the pressure which is to be maintained. Pressure is not critical and any pressure within the limits of the vessel can be used. Generally, a pressure of from about 5 to 25 psig or higher can be used. In the in-situ applications of this invention, pressures at least as great as the prevailing pressure within the deposit will be required.

The bottom of the vessel was maintained at the temperatures of about 110 degrees Fahrenheit for several hours, and with the bottom of the vessel still heated, about 5 gallons of bitumen relatively free of any solvent was withdrawn from the valved port in the bottom of the vessel. After the vessel had cooled to room temperature, the methylene chloride solvent was withdrawn through the valved port in the bottom of the vessel. The withdrawn solvent contained a small amount of bitumen dissolved therein. Clean sand containing very little bitumen was then removed from the vessel. The sand could be further treated to recover other mineral values therefrom or disposed of without creating a pollution problem.

While particular embodiments of the invention have been described and illustrated herein, it is to be understood that various changes and modifications may be made without departing from the subject matter coming within the scope of the following claims, which subject matter is regarded as the invention.

I claim:

1. A process for separating bituminous material from inorganic matter containing same, said process comprising:

introducing the bituminous containing, inorganic matter into a confined space, said confined space comprising an enclosed chamber or vessel having a valved port at the bottom thereof, at least one closeable opening therein through which the inorganic matter can be changed to said chamber, and means for charging the halogenated organic solvent thereto;

introducing a halogenated organic solvent into the chamber;

contacting the inorganic matter contained within the confined space with the vapors of the halogenated organic solvent, whereby the solvent vapors interact with the bituminous material so that the bituminous material separates from the inorganic matter and accumulates at the bottom of said confined space;

heating the bottom portion of said confined space adjacent to said valved port so that the temperature of the bituminous material and any halogenated organic solvent which accumulates within the bottom portion of said confined space is maintained above the boiling point of said halogenated organic solvent at the pressure within the confined space; and withdrawing the accumulated bituminous material from the bottom of said confined space through said valved port.

2. A process in accordance with claim 1, wherein residual organic solvent contained in the withdrawn bituminous material is flashed therefrom and reintroduced into said confined space.

3. A process in accordance with claim 1, wherein the halogenated, organic solvent is selected from the groups consisting of methylene chloride, trichlormonoflouromethane, chloroform, methyl chloroform, carbon tetrachloride, bromotrichloromethane, dibromotetrafluoromethane, trichloroethane, trichloroethylene, tetrachloroethane, tetrachloroethylene, hexachloroethane, pentachloromonofluoroethane, pentachloroethane, tetrachlorodifluoroethane, trichlorotrifluoroethane, dibromotetrafluoroethane, dichlorotrifluoroethane, and dichlorotetrafluoromethane.

4. A process in accordance with claim 1, wherein inorganic matter from which the bituminous material has been separated is removed at least periodically from said confined space and replaced with raw inorganic matter containing bituminous material.

5. A process in accordance with claim 1, wherein the inorganic matter containing bituminous material comprises tar sands.

* * * * *